United States Patent [19]

Yasuda et al.

[11] Patent Number: 4,670,065

[45] Date of Patent: Jun. 2, 1987

[54] COLD ROLLED STEEL SUITABLE FOR ENAMEL COATING AND METHOD FOR MAKING

[75] Inventors: Akira Yasuda; Junko Ikehira; Kenji Itoh; Junsuke Takasaki; Kozou Tsunoyama, all of Chiba, Japan

[73] Assignee: Kawasaki Steel Corporation, Kobe, Japan

[21] Appl. No.: 792,697

[22] Filed: Oct. 15, 1985

[30] Foreign Application Priority Data

Oct. 24, 1984 [JP] Japan ..... 59-223780
May 30, 1985 [JP] Japan ..... 60-117294

[51] Int. Cl.[4] ..... C21D 1/00

[52] U.S. Cl. ..... 148/2; 148/320; 148/332; 148/12.1; 148/12 C; 148/12 F

[58] Field of Search ..... 75/123 AA, 123 M, 123 B; 148/36, 3, 2, 12 C, 12.1, 12 F, 320, 332; 164/476, 477; 420/84, 126, 128

[56] References Cited

U.S. PATENT DOCUMENTS

| | | | |
|---|---|---|---|
| 2,492,019 | 12/1949 | Thompson | 75/123 R |
| 3,939,013 | 2/1976 | Gardner et al. | 148/12.1 |
| 3,950,191 | 4/1976 | Ito et al. | 148/12.1 |
| 4,326,886 | 4/1982 | Abeyama et al. | 75/126 M |
| 4,328,032 | 5/1982 | Mancini et al. | 148/12 C |

FOREIGN PATENT DOCUMENTS

| | | | |
|---|---|---|---|
| 56-9357 | 1/1981 | Japan | 75/123 B |
| 1040140 | 8/1966 | United Kingdom . | |
| 1094745 | 12/1967 | United Kingdom . | |
| 1096010 | 12/1967 | United Kingdom . | |
| 1128268 | 9/1968 | United Kingdom . | |
| 1278900 | 6/1972 | United Kingdom . | |

*Primary Examiner*—L. Dewayne Rutledge
*Assistant Examiner*—Deborah Yee
*Attorney, Agent, or Firm*—Young & Thompson

[57] ABSTRACT

A cold rolled steel sheet suitable for enamel coating is provided which consists essentially of, on a weight basis, C: up to 0.005%,
P: up to 0.02%,
S: up to 0.03%,
N: 0.005% to 0.012%,
Ti: up to 0.15% and $$Ti \geqq (48/12C + 48/14N + 48/32S)\%,$$

Cu: up to 0.08%, and at least one member selected from As, Sb, and Bi in a total amount of 0.003% to 0.03% or Se and/or Te in a total amount of 0.003% to 0.05% or their combination in a total amount of 0.002 to 0.05%, the balance being Fe and concomitant impurities. The steel is produced by continuously casting a molten steel having the same composition as above, hot rolling and then cold rolling the steel, and continuously annealing the steel at a temperature in the range from the recrystallization temperature to the $Ac_3$ point. It is also produced by substantially the same procedure but by box annealing the steel having a titanium content increased at a temperature in the range from the recrystallization temperature to 800° C.

9 Claims, 2 Drawing Figures

COLD ROLLED STEEL SUITABLE FOR ENAMEL COATING AND METHOD FOR MAKING

BACKGROUND OF THE INVENTION

1. Field of the Invention

This invention relates to cold rolled steel sheets to be enamel coated having improved press moldability and weldability as well as improved enameling properties, and a method for making the same.

2. Prior Art

Steel sheets to be coated with porcelain enamel or ceramic have to exhibit excellent enameling properties including enamel adherence, baking distortion, and fish-scaling resistance. In addition, they are required to be press moldable because most enameled steel stocks are press molded into end products under relatively severe conditions.

It is well known in the art, for example, from Japanese Patent Publication Nos. 42-12348 and 44-18066 that titanium steels, particularly those steels based on super-low carbon steel with not more than 0.02 wt % C having titanium added thereto have high press moldability. Techniques for improving enameling properties while taking advantage of the press moldability of titanium steel are disclosed in Japanese Patent Publication No. 45-40655 and Japanese Patent Application Kokai Nos. 53-131919 and 56-9357.

These techniques are effective in improving scaling resistance among other enameling properties while preserving good press moldability. By utilizing the tendency of titanium to form carbide, sulfide, and nitride in steel, these techniques increase the hydrogen occlusion capacity of steel in order to minimize the scaling susceptibility.

Titanium must be added in a sufficient amount to exert its effect to a full extent. Large amounts of titanium added, however, adversely affect enamel adherence. For this reason, titanium steel could find only a limited range of utility as steel stock to be enamel coated although it possessed excellent press moldability and scaling resistance.

After steel sheets to be enamel coated are worked into shapes, they are often welded by a variety of methods. As compared with capped steel commonly used as enameled steel, titanium steel, however, is inefficient in welding operation and there often appear deficiencies such as blowholes in welded zones. Particularly, significant "shrinkage" occurs in welded zones, which develops itself in stripe form after enamel baking. Blowholes lead to bubble defects. Capped steel is thus primarily used in such applications requiring welding where titanium steel has not found utility.

OBJECT OF THE INVENTION

One object of the present invention is to provide a new and improved steel sheet suitable for enamel coating having excellent enameling properties as well as press moldability.

Another object of the present invention is to provide a new and improved steel sheet suitable for enamel coating having excellent enameling and welding properties as well as press moldability.

A further object of the present invention is to provide a cold rolled titanium steel sheet having such improved properties.

Still another object of the present invention is to provide a method for making such a cold rolled steel sheet suitable for enamel coating.

SUMMARY OF THE INVENTION

Titanium steel has poor enamel adherence because pickling with sulfuric acid necessary prior to enameling leaves a considerable amount of pickling products ($FeSO_4 \cdot nH_2O$) on the steel surface. We have found that the addition of As, Sb, and/or Bi to titanium steel is effective in preventing pickling products from depositing, thereby improving the enamel adherence of titanium steel.

In the course of our research work, we have also found that the addition of Se and/or Te provides the same effect as As, Sb, and Bi, but to a less extent while improving weldability. The addition of a mixture of at least one member of the As, Sb, and Bi group and at least one member of the Se and Te group provides synergistic effects.

According to a first aspect of the present invention, there is provided a cold rolled steel sheet suitable for enamel coating, consisting essentially of, on a weight basis, C: up to 0.005%,
P: up to 0.02%,
S: up to 0.03%,
N: 0.005% to 0.012%,
Ti: up to 0.15% and $$Ti \geqq (48/12C + 48/14N + 48/32S)\%,$$

Cu: up to 0.08%, and
at least one member selected from the group consisting of As, Sb, and Bi in a total amount of 0.003% to 0.03%, balance essentially iron.

According to a second aspect of the present invention, there is provided a method for making a cold rolled steel sheet suitable for enamel coating, having improved press moldability, enamel adherence, and scaling resistance comprising continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C + 48/14N + 48/32S)\%,$$

Cu: up to 0.08%, and
at least one member selected from the group consisting of As, Sb, and Bi in a total amount of 0.003% to 0.03%, balance essentially iron, hot rolling and then cold rolling the steel, and continuously annealing the steel at a temperature in the range from the recrystallization temperature to the $Ac_3$ point.

According to a third aspect of the present invention, there is provided a method for making a cold rolled steel sheet suitable for enamel coating, having improved press moldability, enamel adherence, and scaling resistance comprising continuously casting a molten steel consisting essentially of, on a weight basis,
C: up to 0.005%,
P: up to 0.02%, S: up to 0.03%,
N: 0.005% to 0.012%,
Ti: up to 0.15% and $$Ti \geqq (48/12C+48/14N+48/32S+0.03)\%,$$

Cu: up to 0.08%, and
at least one member selected from the group consisting of As, Sb, and Bi in a total amount of 0.003% to 0.03%, balance essentially iron,
hot rolling and then cold rolling the steel, and
box annealing the steel at a temperature in the range from the recrystallization temperature to 800° C.

According to a fourth aspect of the present invention, there is provided a cold rolled steel sheet suitable for enamel coating, consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S)\%,$$

Cu: up to 0.08%, and
at least one member selected from the group consisting of Se and Te in a total amount of 0.003% to 0.05%, balance essentially iron.

According to a fifth aspect of the present invention, there is provded a method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S)\%,$$

Cu: up to 0.08%, and
at least one member selected from the group consisting of Se and Te in a total amount of 0.003% to 0.05%, balance essentially iron,
hot rolling and then cold rolling the steel, and
continuously annealing the steel at a temperature in the range from the recrystallization temperature to the $Ac_3$ point.

According to a sixth aspect of the present invention, there is provided a method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S+0.03)\%,$$

Cu: up to 0.08%, and
at least one member selected from the group consisting of Se and Te in a total amount of 0.003% to 0.05%, balance essentially iron,
hot rolling and then cold rolling the steel, and
box annealing the steel at a temperature in the range from the recrystallization temperature to 800° C.

According to a seventh aspect of the present invention, there is provided a cold rolled steel sheet suitable for enamel coating, consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S)\%,$$

Cu: up to 0.08%, and
at least one member selected from the group consisting of As, Sb, and Bi plus at least one member selected from the group consisting of Se and Te in a total amount of 0.002% to 0.05%, balance essentially iron.

According to an eighth aspect of the present invention, there is provided a method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S)\%,$$

Cu: up to 0.08%, and
at least one member selected from the group consisting of As, Sb, and Bi plus at least one member selected from the group consisting of Se and Te in a total amount of 0.002% to 0.05%, balance essentially iron,
hot rolling and then cold rolling the steel, and
continuously annealing the steel at a temperature in the range from the recrystallization temperature to the $Ac_3$ point.

According to a ninth aspect of the present invention, there is provided a method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S+0.03)\%,$$

Cu: up to 0.08%, and
at least one member selected from the group consisting of As, Sb, and Bi plus at least one member selected from the group consisting of Se and Te in a total amount of 0.002% to 0.05%, balance essentially iron, hot rolling and then cold rolling the steel, and box annealing the steel at a temperature in the range from the recrystallization temperature to 800° C.

The term "up to" is used herein in an inclusive sense. The term "balance essentially iron" used herein does not exclude the presence of concomitant impurities.

DETAILED DESCRIPTION OF THE INVENTION

Figure 1:
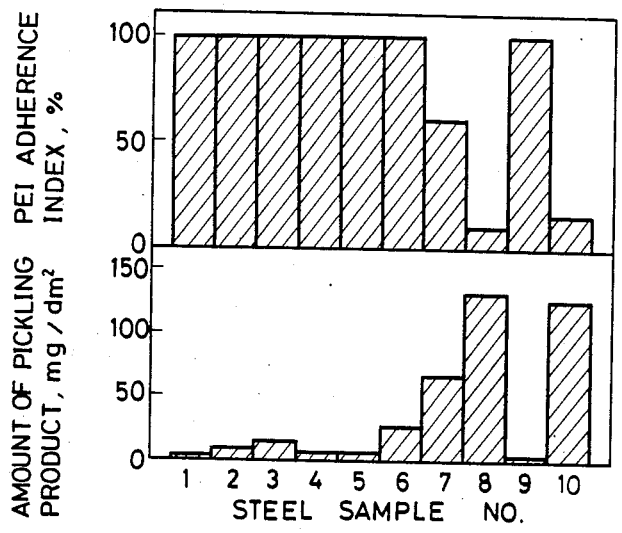
FIG. 1 is a diagram graphically illustrating the enamel adherence and the amount of pickling products deposited of continuously annealed steel sheet samples prepared in Example 1.

To each of the elements contained in the cold rolled steel of the present invention, limits are imposed for the following reason. All percents are by weight unless otherwise stated.

Carbon (C)

The presence of carbon in solid-solution state deteriorates the ductility and r value, that is, plastic strain ratio of steel. Carbon is present in the form of TiC in those steels having a sufficient content of titanium, giving less influence on the ductility and $\bar{r}$ value. However, the presence of carbon in excess of 0.005% would deteriorate ductility and increase the amount of titanium required to fix carbon as TiC, resulting in deteriorated enamel adherence and increased cost. The upper limit of 0.005% is thus imposed to carbon content.

Phosphorus (P)

Phosphorus is present in steel as a concomitant impurity. As the phosphorus content increases, the ductility of steel is deteriorated with marked secondary working embrittlement. By the term secondary working embrittlement is meant the phenomenon that a press molded part of sheet steel undergoes brittle fracture under low stress. Such embrittlement may be avoided by effecting continuous annealing or adding a sufficient amount of titanium and lowering the phosphorus content to 0.02% or below.

Sulfur (S)

Like phosphorus, sulfur is also present in steel as a concomitant impurity. In general, sulfur is a detrimental element that induces hot shortness, causes surface defects to occur during hot rolling, and reduces the ductility of steel even after it is cold rolled. If titanium is present in a sufficient amount to convert sulfur into titanium sulfide, these detrimental effects are reduced. However, more amounts of sulfur need more amounts of titanium to be added, undesirably increasing cost. The upper limit of 0.03% is thus imposed to sulfur content.

Nitrogen (N)

Nitrogen is an element essential to improve scaling resistance among other enameling properties of sheet steel of the present invention. In steel having titanium added thereto, nitrogen is present in the form of TiN. The higher the nitrogen content, the more the scaling resistance is improved.

The presence of TiN results in formation of voids in steel during cold rolling, which serve to occlude hydrogen that otherwise causes scaling susceptibility. Scaling is thus effectively controlled particularly when N is present in an amount of 0.005% or higher. If nitrogen content is excessively increased and the amount of titanium added to fix the nitrogen is accordingly increased, spill-like defects can occur on the sheet steel surface. Spill-like defects scarecely occur with nitrogen contents of 0.012% or lower. The nitrogen content should thus range from 0.005% to 0.012%.

Titanium (Ti)

Titanium added to steel is effective to fix carbon, nitrogen, and sulfur as TiC, TiN, and TiS, respectively, and thus not only mitigates the adverse effect of these detrimental elements on the steel matrix, but also controls scaling. In order to fully exert such effects, titanium should be present in a sufficient amount to fix carbon, nitrogen and sulfur, that is, in an amount of $(48/12C+48/14N+48/32S)\%$ or higher wherein C, N, and S represent the weight contents of carbon, nitrogen, and sulfur in steel, respectively.

Titanium also forms a phosphide in the form of TiFeP in steel. When cold rolled steel sheets are continuously annealed, secondary working embrittlement does not take place because of increased cooling rate. In the case of box or pack annealing with low cooling rate, phosphorus segregates at the grain boundary during cooling, inviting secondary working embrittlement. In the case of box annealing, titanium should be added in an extra amount sufficient to form a phosphide in addition to that required to form carbide, nitride, and sulfide in order to fix phosphorus as phosphide, thereby preventing grain boundary segregation and suppressing secondary working embrittlement. The mininum amount of titanium necessary for this purpose is $(48/12C+48/14N+48/32S+0.03)\%$. However, an excess amount of titanium added not only increase the cost of steel, but also causes a continuous casting nozzle to be readily blocked and spill-like defects to appear and will sometimes deteriorate enamel adherence and weldability. To eliminates these problems, the upper titanium content should be limited to 0.15%.

Copper (Cu)

Copper is contained in steel as a concomitant impurity in an amount of 0.01% or higher. In general, cold rolled sheet steel is pickled with sulfuric acid prior to enameling. The adaptability of sheet steel to pickling is largely affected by copper. As the copper content in steel increases, pickling is appreciably slowed down. Pickling products readily deposit on the steel surface with increased contents of copper, causing reduction in enamel adherence. Particularly, copper helps pickling rate to progressively increase during an extended period of pickling, enhancing the deposition of pickling products. Promoted deposition of pickling products due to copper is retarded by the addition of As, Sb, Bi, Se or Te. In order to minimize the cost increase due to the addition of these elements, the upper copper content should be limited to 0.08%.

Arsenic (As), Antimony (Sb), and Bismuth (Bi)

Deposition of pickling products on the steel surface can be prevented by adding at least one of these elements belonging to Group 5A in the Periodic Table. Although it is unclear how these elements prevent deposition of pickling products, it is believed that they inactivate adsorption sites of pickling products ($FeSO_4.nH_2O$) on the steel surface. In order that such an effect is reliable, one or more members of these elements should be present in a total amount of at least 0.003%. Amounts in excess of 0.03% retard pickling and cause much spill-like defects to occur during hot rolling. At least one member selected from the group consisting of As, Sb, and Bi should preferably be added in amounts from 0.005% to 0.03% in order to avoid cost increase while expecting sufficient effect.

Selenium (Se) and Tellurium (Te)

The addition of at least one of these elements belonging to Group 6A in the Periodic Table is also effective in controlling the deposition of pickling products to the steel surface, but to a lesser extent than As, Sb, and Bi. Although it is unclear how these elements prevent deposition of pickling products, it is believed that they inactivate adsorption sites of pickling products ($FeSO_4.nH_2O$) on the steel surface. The addition of Se and/or Te also improves welding operation efficiency and prevents blowhole defects from occurring. Although it is unclear how these elements improve weldability, it is believed that they reduce the surface tension of molten iron to ensure that fuse welding be readily achieved at increased welding speeds. In order that welding improvement is expectable and deposition of pickling products to the steel surface is controlled, selenium and/or tellurium should be added in an amount of at least 0.003%. Amounts in excess of 0.05% will result in increased cost, blockage of a continuous casting nozzle, and quality deterioration. At least one member selected from the group consisting of Se and Te should preferably be added in amounts from 0.005% to 0.05% in order to avoid cost increase while expecting sufficient effect.

As described above, the addition of As, Sb, and/or Bi is effective in preventing deposition of pickling products onto the steel surface, but ineffective in improving weldability whereas the addition of Se and/or Te is also effective in weldability improvement. Then, the addition of mixtures of at least one member selected from the group consisting of As, Sb, and Bi and at least one member selected from the group consisting of Se and Te can effectively improve both enamel adherence and weldability. The addition of at least one member of As, Sb, and Bi combined with at least one member of Se and Te in a total amount of 0.002% is expected to exert these effects. Total amounts in excess of 0.05% retard pickling and invite cost increase and quality deterioration. The amount of mixtures of the two group elements is thus limited to the range from 0.002% to 0.05%.

The cold rolled steel making method of the present invention will be described. Cold rolled steel sheet suitable for enamel coating is produced by continuously casting a molten steel having precisely controlled contents of the afore-mentioned elements, hot rolling and then cold rolling the steel, and thereafter continuously annealing or box annealing the steel.

The steps of continuous casting, hot rolling, and cold rolling may be carried out in a conventional, well-known manner. The cold rolled steel sheet may be continuously annealed at a temperature in the range from the recrystallization temperature to the $Ac_3$ point because secondary working embrittlement never occurs during continuous annealing with increased cooling rate. In the case of box or pack annealing, however, the cold rolled steel sheet should be annealed at a temperature in the range from the recrystallization temperature to 800° C. in order to effectively form TiFeP. At box annealing temperatures in excess of 800° C., titanium and phosphorus increase their solubility to such a level as to obstruct precipitation of TiFeP. Box annealing temperatures of 750° C. or lower are preferable for economy and prevention of laminating.

EXAMPLES

In order that those skilled in the art will better understand how to practice the present invention, examples are presented below by way of illustration and not by way of limitation. All percents are by weight unless otherwise stated.

EXAMPLE 1

Steel batches having the compositions shown in Table 1 were melted and continuously cast into slabs which were hot rolled, cold rolled, and then continuously annealed at 800° C. for 20 seconds to produce cold rolled steel sheets. The steel sheets were further subjected to skin pass rolling at 0.8% before they were examined for various mechanical and enamel properties. The measured mechanical properties are yield strength (YS), tensile strength (TS), elongation (El) and $\bar{r}$ value, that is, average plastic strain ratio, and the measured enameling property is scaling resistance.

The measured properties of the steel samples are shown in Table 2. Except sample No. 10 having a carbon content of 0.008%, all the steel samples exhibited good press moldability as demonstrated by an elongation of at least 48% and an $\bar{r}$ value of at least 1.8.

The results of a scaling test performed on the steel samples are also shown in Table 2. The scaling test was performed by pickling a cold rolled steel sample for 20 seconds, applying a commercially available glaze (L type glaze manufactured and sold by Nihon Fellow K.K.), and baking the glaze at 820° C. in an enameling furnace having a dew point of 30° C. The thus enameled steel sample was examined for fish scaling. For each steel sheet sample, twenty specimens were glazed and baked. Scaling resistance is expressed in percentage of scaled specimens. Except sample Nos. 8 and 9 having low nitrogen contents, all the samples were free of scaling, proving that there was produced steel sheets having improved quality and scaling resistance.

However, enamel adherence widely varies with a particular steel sheet. FIG. 1 illustrates the amount of pickling product formed after pickling of steel sheets with sulfuric acid at 70° C. for 15 minutes. The pickled steel sheets were pretreated by immersing in 2% nickel sulfate solution at 65° C. for 10 minutes, coated with a commercial titanium white glaze, and baked in an enameling furnace at 820° C. The adherence of the resulting enamel coating to the steel substrate was examined. The results are also plotted in FIG. 1. The enamel adherence is expressed by the P.E.I. enamel adherence index determined by an adherence test prescribed by the Porcelain Enamel Institute of the United States.

Those steel sheets free of Sb, As, or Bi were found to bear a greater amount of pickling product and have varying enamel adherence. Sample No. 7 only showed a PEI index of 60% which is the best enamel adherence among them.

On the contrary, little pickling product deposited on those steel sheets containing As, Sb or Bi. They exhibited excellent enamel adherence.

EXAMPLE 2

Steel batches having the compositions shown in Table 3 were melted and continuously cast into slabs which were hot rolled, cold rolled, and then box annealed at 720° C. for 10 hours. The steel sheets were further subjected to skin pass rolling at 0.8% to produce cold rolled steel sheets of 0.7 mm thick before they were examined for the same mechanical and enamel properties as in Example 1. The measured properties of the steel samples are shown in Table 4.

Secondary working embrittlement resistance was examined by drawing a sheet into a cylindrical cup at a drawing ratio of 2:1, keeping the cup at varying temperatures from room temperature to −60° C., and falling a weight of 5 kg from a height of 1 m. The temperature at which longitudinal cracks occur in the cup is evaluated as the critical temperature at crack. The lower the critical temperature, the more improved is the secondary working embrittlement resistance.

All of the steel sheet samples showed excellent press moldability as demonstrated by $\bar{r}>1.8$ and El>50%. Sample Nos. 15 and 17 having lower titanium contents were susceptible to longitudinal crack even at 0° C., displaying undesirable secondary working embrittlement. On the contrary, those steel samples having a titanium content falling within the specific range of the present invention were resistant to longitudinal crack even at −60° C., displaying excellent secondary working embrittlement.

Figure 2:
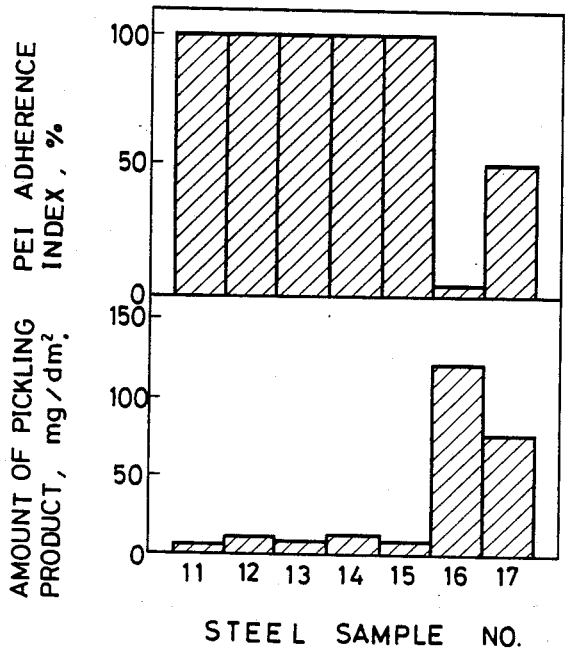
FIG. 2 is a diagram graphically illustrating the enamel adherence and the amount of pickling products deposited of box annealed steel sheet samples prepared in Example 2.

FIG. 2 illustrates the amount of pickling product and the enamel adherence of the steel sheet samples of this example. The procedures of measurement are the same as in Example 1. As evident from the diagram of FIG. 2, those steel sheets containing Sb, As or Bi exhibited excellent enamel adherence whereas steel sample Nos. 16 and 17 free of these elements had an increased amount of pickling product deposited and failed to provide enamel adherence.

TABLE 1

| Sample No. | Steel Composition (% by weight) | | | | | | | | |
|---|---|---|---|---|---|---|---|---|---|
| | C | P | S | Ti | Cu | Sb | As | Bi | N |
| 1 | 0.003 | 0.015 | 0.010 | 0.064 | 0.03 | 0.010 | — | — | 0.007 |
| 2 | 0.002 | 0.014 | 0.009 | 0.060 | 0.02 | — | 0.010 | — | 0.006 |
| 3 | 0.003 | 0.014 | 0.011 | 0.059 | 0.03 | — | — | 0.010 | 0.007 |
| 4 | 0.003 | 0.015 | 0.009 | 0.058 | 0.03 | 0.005 | 0.005 | — | 0.009 |
| 5 | 0.002 | 0.012 | 0.010 | 0.055 | 0.02 | 0.005 | — | 0.003 | 0.009 |
| 6 | 0.002 | 0.011 | 0.011 | 0.060 | 0.03 | 0.002 | 0.002 | — | 0.008 |
| 7* | 0.003 | 0.013 | 0.009 | 0.055 | 0.04 | — | — | — | 0.007 |
| 8* | 0.003 | 0.014 | 0.008 | 0.17 | 0.03 | — | — | — | 0.004 |
| 9* | 0.002 | 0.013 | 0.010 | 0.055 | 0.03 | 0.007 | — | — | 0.003 |
| 10* | 0.008 | 0.012 | 0.008 | 0.11 | 0.02 | — | — | — | 0.008 |

*Comparison

TABLE 2

| Sample NO. | Properties | | | | | Remarks |
|---|---|---|---|---|---|---|
| | YS (kgf/mm²) | TS (kgf/mm²) | El (%) | $\bar{r}$ | Scaling resistance (%) | |
| 1 | 16 | 29 | 52 | 1.9 | 0 | |
| 2 | 15 | 30 | 52 | 1.9 | 0 | |
| 3 | 16 | 30 | 51 | 1.9 | 0 | |
| 4 | 17 | 30 | 52 | 2.0 | 0 | |
| 5 | 16 | 29 | 53 | 2.0 | 0 | |
| 6 | 15 | 31 | 50 | 1.8 | 0 | |

TABLE 2-continued

| Sample NO. | Properties | | | | | Remarks |
|---|---|---|---|---|---|---|
| | YS (kgf/mm²) | TS (kgf/mm²) | El (%) | $\bar{r}$ | Scaling resistance (%) | |
| 7* | 14 | 30 | 52 | 1.9 | 0 | |
| 8* | 14 | 30 | 52 | 1.9 | 95 | slight spills |
| 9* | 15 | 30 | 51 | 1.9 | 100 | |
| 10* | 18 | 32 | 45 | 1.9 | 0 | |

*Comparison

TABLE 3

| Sample No. | Steel Composition (% by weight) | | | | | | | | |
|---|---|---|---|---|---|---|---|---|---|
| | C | P | S | Ti | Cu | Sb | As | Bi | N |
| 11 | 0.003 | 0.014 | 0.010 | 0.093 | 0.03 | 0.009 | — | — | 0.007 |
| 12 | 0.002 | 0.015 | 0.009 | 0.088 | 0.04 | — | 0.010 | — | 0.006 |
| 13 | 0.003 | 0.014 | 0.009 | 0.100 | 0.04 | — | — | 0.011 | 0.007 |
| 14 | 0.003 | 0.014 | 0.009 | 0.94 | 0.03 | 0.005 | 0.003 | — | 0.006 |
| 15* | 0.002 | 0.013 | 0.010 | 0.068 | 0.04 | 0.008 | — | — | 0.008 |
| 16* | 0.003 | 0.015 | 0.011 | 0.098 | 0.03 | — | — | — | 0.009 |
| 17* | 0.002 | 0.014 | 0.010 | 0.073 | 0.04 | — | — | — | 0.008 |

*Comparison

TABLE 4

| Sample NO. | Properties | | | | Critical temperature at crack (°C.) |
|---|---|---|---|---|---|
| | YS (kgf/mm²) | TS (kgf/mm²) | El (%) | $\bar{r}$ | |
| 11 | 14 | 30 | 54 | 1.9 | <−60 |
| 12 | 13 | 29 | 53 | 1.9 | <−60 |
| 13 | 14 | 30 | 53 | 2.0 | <−16 |
| 14 | 14 | 30 | 54 | 2.0 | <−60 |
| 15* | 14 | 29 | 53 | 1.9 | 0 |
| 16* | 12 | 29 | 54 | 2.0 | <−60 |
| 17* | 13 | 30 | 53 | 2.0 | 0 |

*Comparison

EXAMPLE 3

Steel batches having the compositions shown in Table 5 were melted and continuously cast into slabs which were hot rolled, cold rolled, and then continuously annealed at 800° C. for 20 seconds to produce cold rolled steel sheets of 0.8 mm thick. The steel sheets were further subjected to skin pass rolling at 0.8% before they were examined for the same mechanical properties as in Example 1.

The measured mechanical properties of the steel samples are shown in Table 6. Except sample No. 121 having a carbon content in excess of 0.005%, all the steel samples exhibited good press moldability as demonstrated by an elongation of at least 50% and an $\bar{r}$ value of at least 1.8.

The results of a scaling test performed on the steel samples are also shown in Table 6. The scaling test was performed by pickling a cold rolled steel sample for 20 seconds, applying a commercially available glaze (L type glaze manufactured and sold by Nihon Fellow K.K.), and baking the glaze at 820° C. in an enameling furnace having a dew point of 30° C. The thus enameled steel sample was examined for fish scaling. For each steel sheet sample, twenty specimens were glazed and baked. Scaling resistance is expressed in percentage of scaled specimens. Except sample Nos. 117, 119 and 120 having low nitrogen contents, all the samples were free of scaling, proving that there was produced steel sheets having improved quality and scaling resistance.

The amount of pickling product deposited on steel sheets was determined after pickling them with 10% sulfuric acid at 70° C. for 15 minutes. The pickled steel sheets were pretreated by immersing in 2% nickel sulfate solution at 65° C. for 10 minutes, coated with a commercial titanium white glaze, and baked in an enameling furnace at 820° C. The adherence of the resulting enamel coating to the steel substrate was examined. The results are also shown in Table 6. The enamel adherence is expressed by the P.E.I. enamel adherence index.

Those steel sheets free of Se, Te, Sb, As, or Bi were found to have a PEI index of lower than 60%.

Each steel sheet sample was welded by means of a plasma arc welding machine at a welding current of 65 amperes and a welding speed of 1 m/min. The weld was subjected to appearance and transmissive X-ray observations. The results are also shown in Table 6.

Sample Nos. 101–106 and 117–121 which did not contain Se or Te displayed "shrinkage" and blowhole defects after welding. It is demonstrated that those steel sheets falling in the scope of the present invention exhibit improved weldability as well as satisfactory press moldability, scaling resistance and enamel adherence.

EXAMPLE 4

Steel batches having the compositions shown in Table 7 werr melted and continuously cast into slabs which were hot rolled, cold rolled, and then box annealed at 720° C. for 10 hours. The steel sheets were further subjected to skin pass rolling at 0.8% to produce cold rolled steel sheets of 0.8 mm thick before they were examined for the same mechanical and enamel properties, and weldability as in Example 3. The results are shown in Table 8.

Secondary working embrittlement resistance was examined by drawing a sheet into a cylindrical cup at a drawing ratio of 2:1, cooling the cup at varying temperatures from room temperature to −60° C., and falling a weight of 5 kg from a height of 1 m. The temperature at which longitudinal cracks occur in the cup is evaluated as the critical temperature at crack. The lower the critical temperature, the more improved is the secondary working embrittlement resistance.

All of the steel sheet samples showed excellent press moldability as demonstrated by $\bar{r}$ value of at least 1.9 and elongation of at least 53%. Particularly, those steel samples having Se or Te added in combination with As, Sb or Bi were improved in enamel adherence and weldability. Control steel samples free of Se or Te displayed shrinkage and blowhole defects after welding.

Sample Nos. 131 and 133 having lower titanium contents were susceptible to longitudinal crack even at 0° C., displaying undesirable secondary working embrittlement. On the contrary, those steel samples having a titanium content falling within the specific range of the present invention were resistant to longitudinal crack even at −60° C., displaying excellent secondary working embrittlement.

TABLE 5

| Sample No. | Steel Composition (% by weight) | | | | | | | | | | | |
|---|---|---|---|---|---|---|---|---|---|---|---|---|
| | C | P | S | Ti | N | O | Cu | Sb | As | Bi | Se | Te |
| 101* | 0.003 | 0.015 | 0.010 | 0.064 | 0.007 | 0.0034 | 0.03 | 0.010 | — | — | — | — |
| 102* | 0.002 | 0.014 | 0.009 | 0.060 | 0.006 | 0.0032 | 0.02 | — | 0.010 | — | — | — |
| 103* | 0.003 | 0.014 | 0.011 | 0.059 | 0.007 | 0.0036 | 0.03 | — | — | 0.010 | — | — |
| °104* | 0.003 | 0.015 | 0.009 | 0.058 | 0.009 | 0.0031 | 0.03 | 0.005 | 0.005 | — | — | — |
| 105* | 0.002 | 0.012 | 0.010 | 0.055 | 0.009 | 0.0032 | 0.02 | 0.005 | — | 0.003 | — | — |
| 106* | 0.002 | 0.011 | 0.011 | 0.060 | 0.008 | 0.0040 | 0.03 | 0.002 | 0.002 | — | — | — |
| 107 | 0.003 | 0.015 | 0.010 | 0.055 | 0.007 | 0.0036 | 0.03 | — | — | — | 0.010 | — |
| 108 | 0.003 | 0.015 | 0.010 | 0.060 | 0.006 | 0.0042 | 0.02 | — | — | — | — | 0.010 |
| 109 | 0.003 | 0.013 | 0.010 | 0.058 | 0.007 | 0.0042 | 0.03 | 0.003 | — | — | 0.005 | — |
| 110 | 0.003 | 0.012 | 0.009 | 0.057 | 0.008 | 0.0044 | 0.03 | — | — | 0.002 | 0.002 | — |
| 111 | 0.002 | 0.016 | 0.010 | 0.061 | 0.008 | 0.0037 | 0.02 | — | 0.005 | — | 0.005 | — |
| 112 | 0.002 | 0.014 | 0.010 | 0.057 | 0.009 | 0.0038 | 0.02 | 0.002 | — | — | — | 0.003 |
| 113 | 0.002 | 0.012 | 0.009 | 0.058 | 0.006 | 0.0039 | 0.03 | 0.002 | 0.002 | — | — | 0.002 |
| 114 | 0.003 | 0.013 | 0.010 | 0.058 | 0.007 | 0.0032 | 0.03 | — | — | — | 0.002 | 0.002 |
| 115 | 0.002 | 0.014 | 0.010 | 0.060 | 0.008 | 0.0033 | 0.02 | 0.001 | 0.001 | 0.001 | 0.002 | 0.001 |
| 116 | 0.002 | 0.012 | 0.010 | 0.059 | 0.007 | 0.0033 | 0.02 | 0.015 | 0.010 | — | 0.015 | — |
| 117* | 0.002 | 0.014 | 0.010 | 0.170 | 0.002 | 0.0037 | 0.03 | 0.002 | — | — | — | — |
| 118* | 0.003 | 0.013 | 0.009 | 0.055 | 0.007 | 0.0034 | 0.04 | — | — | — | — | — |
| 119* | 0.003 | 0.014 | 0.008 | 0.170 | 0.004 | 0.0034 | 0.03 | — | — | — | — | — |
| 120* | 0.002 | 0.013 | 0.010 | 0.055 | 0.003 | 0.0031 | 0.03 | 0.007 | — | — | — | — |
| 121* | 0.008 | 0.014 | 0.009 | 0.110 | 0.008 | 0.0032 | 0.02 | — | — | — | — | — |

*Comparison

TABLE 6

| Sample No. | Properties | | | | | | | |
|---|---|---|---|---|---|---|---|---|
| | Tensile Properties | | | | Enamel Properties | | | |
| | YS (Kgf/mm²) | TS (Kgf/mm²) | El (%) | $\bar{r}$ | Scaling resistance (%) | Pickling product (mg/dm²) | PEI adherence index (%) | Weldability |
| 101* | 16 | 29 | 52 | 1.9 | 0 | 4 | 100 | shrinkage |
| 102* | 15 | 30 | 52 | 1.9 | 0 | 8 | 100 | shrinkage |
| 103* | 16 | 30 | 51 | 1.9 | 0 | 12 | 100 | shrinkage |
| 104* | 17 | 30 | 52 | 2.0 | 0 | 5 | 100 | shrinkage |
| 105* | 16 | 29 | 53 | 2.0 | 0 | 5 | 100 | shrinkage |
| 106* | 15 | 31 | 50 | 1.8 | 0 | 25 | 100 | shrinkage |
| 107 | 17 | 30 | 52 | 1.9 | 0 | 10 | 100 | good |
| 108 | 17 | 30 | 51 | 1.9 | 0 | 8 | 100 | good |
| 109 | 16 | 29 | 52 | 1.9 | 0 | 6 | 100 | good |
| 110 | 15 | 29 | 53 | 2.0 | 0 | 16 | 100 | good |

TABLE 6-continued

| Sample No. | Tensile Properties YS (Kgf/mm²) | TS (Kgf/mm²) | El (%) | r̄ | Enamel Properties Scaling resistance (%) | Pickling product (mg/dm²) | PEI adherence index (%) | Weldability |
|---|---|---|---|---|---|---|---|---|
| 111 | 16 | 30 | 52 | 1.9 | 0 | 6 | 100 | good |
| 112 | 15 | 29 | 52 | 2.0 | 0 | 18 | 100 | good |
| 113 | 16 | 29 | 52 | 1.9 | 0 | 20 | 100 | good |
| 114 | 16 | 29 | 52 | 2.0 | 0 | 30 | 100 | good |
| 115 | 17 | 30 | 51 | 1.9 | 0 | 15 | 100 | good |
| 116 | 18 | 30 | 51 | 1.9 | 0 | 2 | 100 | good |
| 117* | 15 | 29 | 51 | 1.9 | 100 | 76 | 60 | shrinkage |
| 118* | 14 | 30 | 52 | 1.9 | 0 | 73 | 60 | shrinkage, blow hole |
| 119* | 14 | 30 | 52 | 1.9 | 95 | 128 | 12 | shrinkage, blow hole |
| 120* | 15 | 30 | 51 | 1.9 | 100 | 3 | 100 | shrinkage |
| 121* | 18 | 32 | 45 | 1.9 | 0 | 117 | 15 | shrinkage, blow hole |

*Comparison

TABLE 7

| Sample No. | Steel Composition (% by weight) C | P | S | Ti | N | O | Cu | Sb | As | Bi | Se | Te |
|---|---|---|---|---|---|---|---|---|---|---|---|---|
| 122* | 0.003 | 0.014 | 0.010 | 0.093 | 0.007 | 0.0033 | 0.03 | 0.009 | — | — | — | — |
| 123* | 0.002 | 0.015 | 0.009 | 0.088 | 0.006 | 0.0036 | 0.04 | — | 0.010 | — | — | — |
| 124* | 0.003 | 0.014 | 0.009 | 0.100 | 0.007 | 0.0042 | 0.04 | — | — | 0.011 | — | — |
| 125* | 0.003 | 0.014 | 0.009 | 0.094 | 0.006 | 0.0031 | 0.03 | 0.005 | 0.003 | — | — | — |
| 126 | 0.003 | 0.013 | 0.010 | 0.100 | 0.007 | 0.0037 | 0.03 | — | — | — | 0.009 | — |
| 127 | 0.003 | 0.014 | 0.010 | 0.098 | 0.007 | 0.0034 | 0.02 | — | — | — | — | 0.010 |
| 128 | 0.002 | 0.013 | 0.009 | 0.110 | 0.006 | 0.0043 | 0.02 | 0.003 | — | — | 0.005 | — |
| 129 | 0.002 | 0.014 | 0.010 | 0.093 | 0.009 | 0.0035 | 0.02 | 0.002 | — | — | — | 0.003 |
| 130 | 0.002 | 0.012 | 0.009 | 0.094 | 0.007 | 0.0039 | 0.03 | 0.002 | 0.002 | — | 0.002 | — |
| 131* | 0.002 | 0.013 | 0.010 | 0.068 | 0.008 | 0.0040 | 0.04 | 0.008 | — | — | — | — |
| 132* | 0.003 | 0.015 | 0.011 | 0.098 | 0.009 | 0.0031 | 0.03 | — | — | — | — | — |
| 133* | 0.002 | 0.014 | 0.010 | 0.073 | 0.008 | 0.0035 | 0.04 | — | — | — | — | — |

*Comparison

TABLE 8

| Sample No. | Tensile Properties YS (Kgf/mm²) | TS (Kgf/mm²) | El (%) | r̄ | Properites Enamel Properties Scaling resistance (%) | Pickling product (mg/dm²) | PEI adherence index (%) | Weldability | Critical temperature at crack (°C.) |
|---|---|---|---|---|---|---|---|---|---|
| 122* | 14 | 30 | 54 | 1.9 | 0 | 10 | 100 | shrinkage | <−60 |
| 123* | 13 | 29 | 53 | 1.9 | 0 | 20 | 100 | shrinkage | <−60 |
| 124* | 14 | 30 | 53 | 2.0 | 0 | 16 | 100 | shrinkage | <−60 |
| 125* | 14 | 30 | 54 | 2.0 | 0 | 21 | 100 | shrinkage | <−60 |
| 126 | 14 | 30 | 54 | 1.9 | 0 | 18 | 100 | good | <−60 |
| 127 | 14 | 30 | 53 | 1.9 | 0 | 17 | 100 | good | <−60 |
| 128 | 14 | 29 | 54 | 2.0 | 0 | 20 | 100 | good | <−60 |
| 129 | 13 | 29 | 54 | 2.0 | 0 | 27 | 100 | good | <−60 |
| 130 | 14 | 30 | 54 | 1.9 | 0 | 22 | 100 | good | <−60 |
| 131* | 14 | 29 | 53 | 1.9 | 0 | 18 | 100 | shrinkage | 0 |
| 132* | 12 | 29 | 54 | 2.0 | 0 | 120 | 10 | shrinkage, blow hole | <−60 |
| 133* | 13 | 30 | 53 | 2.0 | 0 | 78 | 50 | shrinkage, blow hole | 0 |

*Comparison

The benefits of the steel suitable for enamel coating according to the present invention are summarized below.

The cold rolled steel sheet containing 0.003 to 0.03% by weight of at least one element selected from the group consisting of As, Sb and Bi according to the first aspect of the present invention is suitable for enamel coating and has improved press moldability and enameling properties like enamel adherence and scaling resistance as evident from the data in Tables 2 and 4.

The methods for making a cold rolled steel sheet containing 0.003 to 0.03% by weight of at least one element selected from the group consisting of As, Sb and Bi according to the second and third aspects of the present invention including continuous annealing or box annealing at the specified temperature range can produce cold rolled steel sheets suitable for enamel coating having improved press moldability and enameling properties like enamel adherence and scaling resistance, and resistant to secondary working embrittlement even when box annealed.

The cold rolled steel sheet containing 0.003 to 0.05% by weight of Se and/or Te according to the fourth aspect of the present invention is suitable for enamel coating and has improved press moldability, enameling properties like enamel adherence and scaling resistance, and weldability as evident from the data in Tables 6 and 8.

The methods for making a cold rolled steel sheet containing 0.003 to 0.05% by weight of Se and/or Te according to the fifth and sixth aspects of the present invention including continuous annealing or box annealing at the specified temperature range can produce cold rolled steel sheets suitable for enamel coating having improved press moldability, enameling properties like enamel adherence and scaling resistance, and weldability and resistant to secondary working embrittlement even when box annealed.

The cold rolled steel sheet containing 0.002 to 0.05% by weight of at least one element selected from the group consisting of As, Sb and Bi in combination with Se and/or Te according to the seventh aspect of the present invention is suitable for enamel coating and has improved press moldability, enameling properties like enamel adherence and scaling resistance, and weldability as evident from the data in Tables 6 and 8.

The methods for making a cold rolled steel sheet containing 0.002 to 0.05% by weight of at least one element selected from the group consisting of As, Sb and Bi in combination with Se and/or Te according to the eighth and nineth aspects of the present invention including continuous annealing or box annealing at the specified temperature range can produce cold rolled steel sheets suitable for enamel coating having improved press moldability, enameling properties like enamel adherence and scaling resistance, and weldability and resistant to secondary working embrittlement even when box annealed.

We claim:

1. A cold rolled steel sheet suitable for enamel coating, consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S)\%,$$

Cu: up to 0.08%, and
at least one member selected from the group consisting of As, Sb, and Bi in a total amount of 0.003% to 0.03%, balance essentially iron.

2. A method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02T,
S: up to 0.03%,
N: 0.005% to 0.012%,
Ti: up to 0.15% and $$Ti \geqq (48/12+48/14N+48/32S)\%,$$

Cu: up to 0.08%, and
at least one member selected from the group consisting of As, Sb, and Bi in a total amount of 0.003% to 0.03%, balance essentially iron,
hot rolling and then cold rolling the steel, and
continuously annealing the steel at a temperature in the range from the recrystallization temperature to the $Ac_3$ point.

3. A method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S+0.03)\%,$$

Cu: up to 0.08%, and
at least one member selected from the group consisting of As, Sb, and Bi in a total amount of 0.003% to 0.03%, balance essentially iron,
hot rolling and then cold rolling the steel, and
box annealing the steel at a temperature in the range from the recrystallization temperature to 800° C.

4. A cold rolled steel sheet suitable for enamel coating, consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/12C+48/14N+48/32S)\%,$$

Cu: up to 0.08%, and
at least one member selected from the group consisting of Se and Te in a total amount of 0.003% to 0.05%, balance essentially iron.

5. A method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S)\%,$$

Cu: up to 0.08%, and
at least one member selected from the group consisting of Se and Te in a total amount of 0.003% to 0.05%, balance essentially iron,
hot rolling and then cold rolling the steel, and
continuously annealing the steel at a temperature in the range from the recrystallization temperature to the $Ac_3$ point.

6. A method for making a cold rolled steel sheet suitable for enamel coating, having improved press moldability, enamel adherence, and scaling resistance comprising continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S+0.03)\%,$$

Cu: up to 0.08%, and
at least one member selected from the group consisting of Se and Te in a total amount of 0.003% to 0.05%, balance essentially iron,
hot rolling and then cold rolling the steel, and
box annealing the steel at a temperature in the range from the recrystallization temperature to 800° C.

7. A cold rolled steel sheet suitable for enamel coating, consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S)\%,$$

Cu: up to 0.08%, and
at least one member selected from the group consisting of As, Sb, and Bi plus at least one member selected from the group consisting of Se and Te in a total amount of 0.002% to 0.05%, balance essentially iron.

8. A method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S)\%,$$

Cu: up to 0.08%, and
at least one member selected from the group consisting of As, Sb, and Bi plus at least one member selected from the group consisting of Se and Te in a total amount of 0.002% to 0.05%, balance essentially iron,
hot rolling and then cold rolling the steel, and
continuously annealing the steel at a temperature in the range from the recrystallization temperature to the $Ac_3$ point.

9. A method for making a cold rolled steel sheet suitable for enamel coating, having improved press moldability, enamel adherence, and scaling resistance comprising
continuously casting a molten steel consisting essentially of, on a weight basis,
C: up to 0.005%,
P: up to 0.02%,
S: up to 0.03%,
N: 0.005% to 0.012%,
Ti: up to 0.15% and $$Ti \geqq (48/12C+48/14N+48/32S+0.03)\%,$$

Cu: up to 0.08%, and
at least one member selected from the group consisting of As, Sb, and Bi plus at least one member selected from the group consisting of Se and Te in a total amount of 0.002% to 0.05%, balance essentially iron,
hot rolling and then cold rolling the steel, and
box annealing the steel at a temperature in the range from the recrystallization temperature to 800° C.

* * * * *